US011289046B2

(12) United States Patent
Inokuchi

(10) Patent No.: US 11,289,046 B2
(45) Date of Patent: Mar. 29, 2022

(54) DRIVER CIRCUIT

(71) Applicant: ROHM CO., LTD., Kyoto (JP)

(72) Inventor: Hiroyuki Inokuchi, Kyoto (JP)

(73) Assignee: ROHM CO., LTD., Kyoto (JP)

( * ) Notice: Subject to any disclaimer, the term of this patent is extended or adjusted under 35 U.S.C. 154(b) by 0 days.

(21) Appl. No.: 16/679,575

(22) Filed: Nov. 11, 2019

(65) Prior Publication Data

US 2020/0160808 A1 May 21, 2020

(30) Foreign Application Priority Data

Nov. 14, 2018 (JP) ..... JP2018-213452

(51) Int. Cl.
*G09G 3/36* (2006.01)
*B41J 2/045* (2006.01)

(52) U.S. Cl.
CPC ..... *G09G 3/3696* (2013.01); *B41J 2/0455* (2013.01); *B41J 2/04541* (2013.01); *G09G 2300/089* (2013.01); *G09G 2300/0876* (2013.01)

(58) Field of Classification Search
CPC ..... G09G 2330/04; G09G 2310/0291; G09G 2310/0278; G09G 2300/089; G09G 2300/0876; G09G 3/3696; G09G 3/20
See application file for complete search history.

(56) References Cited

U.S. PATENT DOCUMENTS 5,650,636 A * 7/1997 Takemura ..... G02F 1/13624 257/532
5,834,822 A * 11/1998 Hatanaka ..... H01L 27/1446 257/431
5,956,008 A * 9/1999 Kawasaki ..... G09G 3/3688 345/100
2003/0090309 A1* 5/2003 Hunt ..... H03K 5/08 327/309
2003/0117566 A1* 6/2003 Park ..... G09G 3/3677 349/149
2004/0189584 A1* 9/2004 Moon ..... G09G 3/3677 345/100

(Continued)

*Primary Examiner* — Mihir K Rayan
(74) *Attorney, Agent, or Firm* — Cantor Colburn LLP

(57) ABSTRACT

The present invention is targeted at suppressing ringing and overvoltage.

A driver circuit (200) drives a plurality of loads ($Z_1$ to $Z_N$). A plurality of output terminals ($Po_1$ to $Po_N$) are connected to the plurality of loads ($Z_1$ to $Z_N$). A plurality of drivers ($Dr_1$ to $Dr_N$) correspond to the plurality output terminals ($Po_1$ to $PO_N$), and generate driving signals ($Vo_{\#}$) applied to the respectively corresponding load ($Z_{\#}$). A plurality of clamp circuits (260_1 to 260_N) correspond to the plurality of drivers ($Dr_1$ to $Dr_N$), and include Schottky diodes (SD) connected to input nodes or output nodes of the respectively corresponding drivers (Dr).

16 Claims, 18 Drawing Sheets

(56) References Cited

U.S. PATENT DOCUMENTS

| | | | | |
|---|---|---|---|---|
| 2005/0046647 | A1* | 3/2005 | Lee | G09G 3/3688 345/690 |
| 2005/0141143 | A1* | 6/2005 | Ono | G11B 5/39 360/323 |
| 2005/0243043 | A1* | 11/2005 | Jeoung | G09G 3/3688 345/87 |
| 2007/0291042 | A1* | 12/2007 | Kwak | G02F 1/13452 345/535 |
| 2008/0150858 | A1* | 6/2008 | Nishi | G09G 3/20 345/87 |
| 2009/0058918 | A1* | 3/2009 | Shamoun | B41J 2/04581 347/19 |

* cited by examiner

DRIVER CIRCUIT

BACKGROUND OF THE INVENTION

Field of the Invention

The present invention relates to a technology for driving load devices.

Description of the Prior Art

Driver circuits for output terminals having tens, hundreds or over a thousand are used in applications of various purposes. These driver circuits are, for example, gate drivers or source drivers of liquid crystal display panels, chip drivers formed by integrating gate drivers and source drivers, or printer drivers having arrays of piezoelectric devices. A driver circuit is formed as having multiple output terminals (output pins) and being capable of individually controlling electrical states of loads of the respective output terminals.

FIG. 1 shows a block diagram of a display system 100. The display system 100 includes a panel 110, a gate driver 120 and a source driver 130. The panel 110 includes N source lines SL, M gate lines GL, and multiple pixels 112 in a matrix arrangement at intersections of the multiple gate lines GL and the multiple source lines SL. Each pixel 112 includes a thin-film transistor (TFT). The gate of the TFT is connected to the gate line GL, and the source of the TFT is connected to the source line SL.

The gate driver 120 supplies a high-level gate driving voltage $V_G$ sequentially to the multiple gate lines $GL_1$, $GL_2$, . . . and performs selection, such that the TFT of the selected gate line GL is activated (connected). The source driver 130 applies a source driving voltage $V_S$ corresponding to brightness to the multiple source lines SL, so as to set the brightness of the pixels 112 respectively corresponding to the source lines SL.

SUMMARY OF THE INVENTION

Problems to be Solved by the Invention

The Inventor conducted researches on the display system 100 in FIG. 1, and discovered the following problems. FIGS. 2(*a*) to (*c*) show waveforms of the source driving voltage $V_S$ generated by the source driver 130. FIG. 2(*a*) shows the source driver voltage $V_S$ in normal conditions. FIGS. 2(*b*) and (*c*) show the source driver voltage $V_S$ in abnormal conditions. The waveform in FIG. 2(*b*) is relatively blunt compared to that in FIG. 2(*a*), and an error in brightness of pixels is increased (the color is changed) in such conditions. In FIG. 2(*c*), ringing is produced in the source driving voltage $V_S$, and noise is resulted in such conditions.

FIGS. 3(*a*) to (*c*) show waveforms of the gate driving voltage $V_G$ generated by the gate driver 120. FIG. 3(*a*) shows the gate driver voltage $V_G$ in normal conditions. FIGS. 3(*b*) and (*c*) show the source driver voltage $V_S$ in abnormal conditions. The waveform in FIG. 3(*b*) is relatively blunt compared to that in FIG. 3(*a*), and in such conditions, the activation time of the TFT is insufficient and the brightness cannot be correctly set. In FIG. 3(*c*), ringing is produced, and noise is resulted in such conditions.

In view of the issues above, it is an object of the present invention to provide a driver circuit capable of detecting abnormalities of a load device.

Technical Means for Solving the Problems

A driver circuit for driving a plurality load devices is provided according to an embodiment of the present invention. The driver circuit includes: a plurality of output terminals, connected to the plurality of load devices; a plurality of drivers, corresponding to the plurality of output terminals, generating driving signals applied to the respectively corresponding load devices; and a plurality of clamp circuits, corresponding to the plurality of drivers. The driver circuit is integrated on a semiconductor substrate. The clamp circuits include Schottky diodes connected to input nodes or output nodes of the respectively corresponding drivers.

According to the embodiment, Schottky diodes can be used for suppressing overshoot or undershoot. By building a plurality of Schottky diodes in the integrated circuit, the increase in the number of components and installation area can be restrained compared to a situation where the Schottky diodes are installed externally. Further, compared to a situation where the Schottky diodes are installed externally, the Schottky diodes built in the integrated circuit can be disposed close to nodes for suppressing overvoltage or ringing, thereby maximizing effects of suppressing overvoltage or ringing.

Each of the clamp circuits can include: an upper-side Schottky diode, disposed between an input node or an output node of the corresponding driver and a power line; and a lower-side Schottky diode, disposed between the input node or the output node of the corresponding driver and a ground line.

Each of the driver circuits can further include a plurality of bypass circuits corresponding to the plurality of drivers. Each of the bypass circuits can include a capacitor connected to the input node or the output node of the corresponding driver. By coupling with the capacitor between adjacent channels, ringing components invaded from the adjacent channels can be released through the capacitor. Compared to a situation where the multiple capacitors are installed externally, the capacitors built in an integrated circuit can restrain the increase in the number of components and installation area.

Each of the bypass circuits can include: an upper-side capacitor, disposed between the input node or the output node of the corresponding driver and the power line; and a lower-side capacitor, disposed between the input node or the output node of the corresponding driver and the ground line.

The driver circuit can be accommodated in a package having a first direction as lengthwise and a second direction as widthwise, and the plurality of output terminals are disposed and aligned in the first direction. The driver and the Schottky diode corresponding to one output terminal can also be arranged and aligned in the second direction.

The driver circuit can further include a plurality of protection circuits corresponding to the plurality of output terminals. Each of the protection circuits can include a protection diode connected to the corresponding output terminal.

A driver circuit for driving a plurality of load devices is further provided according to another embodiment of the present invention. The driver circuit includes: a plurality of output terminals, connected to a plurality of load devices; a plurality of drivers, corresponding to the plurality of output terminals, each generating a driving signal applied to the corresponding load device; a plurality of first diodes, corresponding to the plurality of output terminals, each connected to the corresponding output terminal; and a plurality of second diodes, corresponding to the plurality of drivers, each connected to an input node or an output node of the corresponding driver. The driver circuit is integrated on a semiconductor substrate. The forward voltage of the second diodes is smaller than that of the first diodes and is high-speed.

According to the embodiment, protection against electrostatic discharge (ESD) can be provided by using the first diodes, and protection against ringing and overvoltage resulted thereby can be provided by using the second diodes.

The second diodes can also be Schottky diodes.

The driver circuit can be a switch type, and each the plurality of drivers can include an analog switch.

The driver circuit can be a charge-discharge type, and each the plurality of drivers can include an amplifier.

The driver circuit can further include an inverter outputting two values including a high-level voltage and a low-level voltage.

The driver circuit can further drive a matrix-type display panel.

The driver circuit can further drive a print head.

Further, all embodiments formed by any combination of the constituents above, and substitution made to methods, devices and systems with respect to the constituents of the present invention, are to be regarded as effective embodiments of the present invention.

Effects of the Invention

Ringing and overvoltage can be suppressed according to the present invention.

DETAILED DESCRIPTION OF THE EMBODIMENTS

Figure 1:
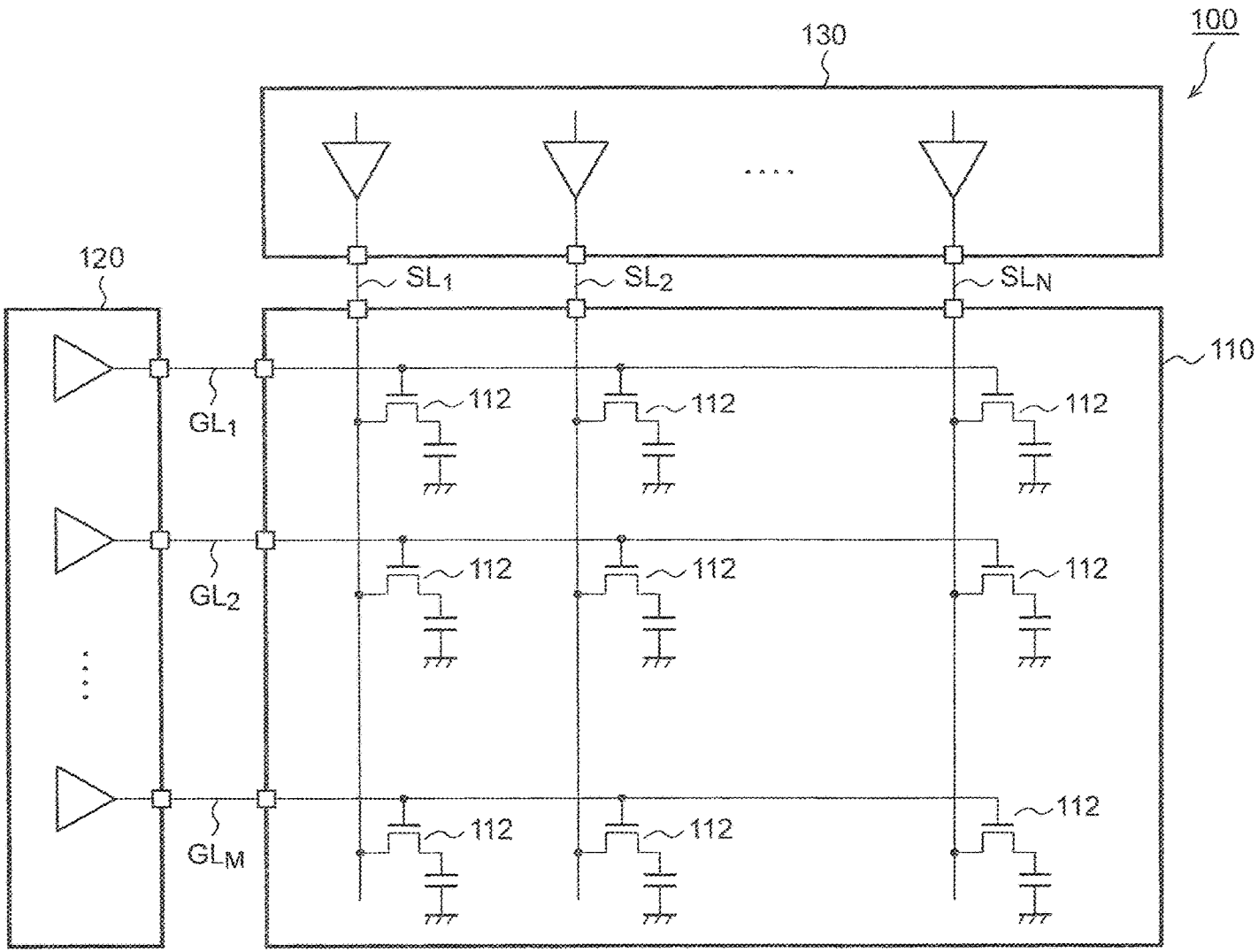
FIG. 1 is a block diagram of a display system.
Figure 2A:
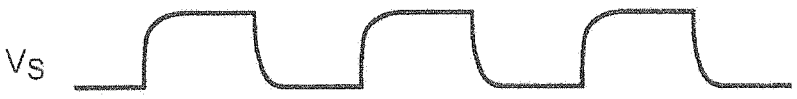
FIGS. 2(*a*) to (*c*) are waveforms of a source driving voltage $V_S$ generated by a source driver.
Figure 2B:
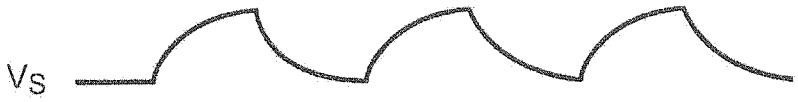
Figure 2C:
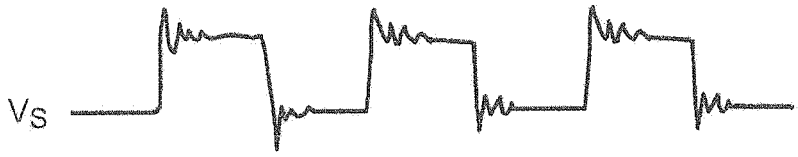
Figure 3A:
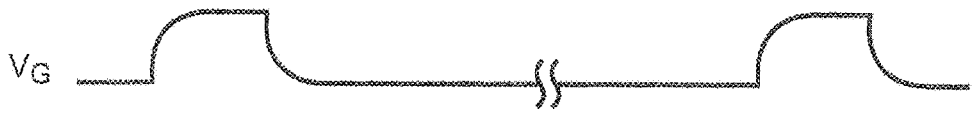
FIGS. 3(*a*) to (*c*) are waveforms of a gate driving voltage $V_G$ generated by a gate driver.
Figure 3B:
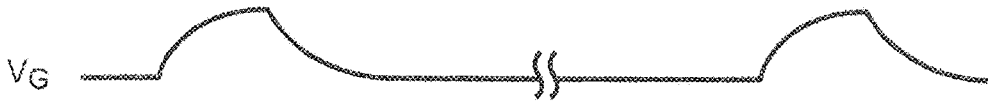
Figure 3C:
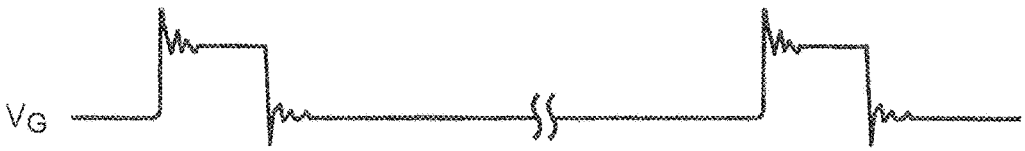

The present invention is described by way of appropriate embodiments with the accompanying drawings below. The same symbols and denotations are assigned to the same or equivalent constituents, components and processes in the drawings, and repeated description is appropriately omitted. Further, the embodiments are merely illustrative and exemplary, and are not to be construed as limitations to the present invention. Further, not all features and combinations thereof stated in the embodiments are necessarily essentials of the present invention.

In the description, an expression of so-called "a state in which component A is connected to component B" includes a situation where component A is physically and directly connected to component B, and further includes a situation where component A is indirectly connected to component B via other components without affecting an electrical connection state. Similarly, the expression of so-called "a state in which component C is disposed between component A and component B" further includes, in addition to a situation where component A, component B and component C are directly connected, a situation of indirect connection via other components without affecting an electrical connection state.

Embodiment 1

Figure 4:
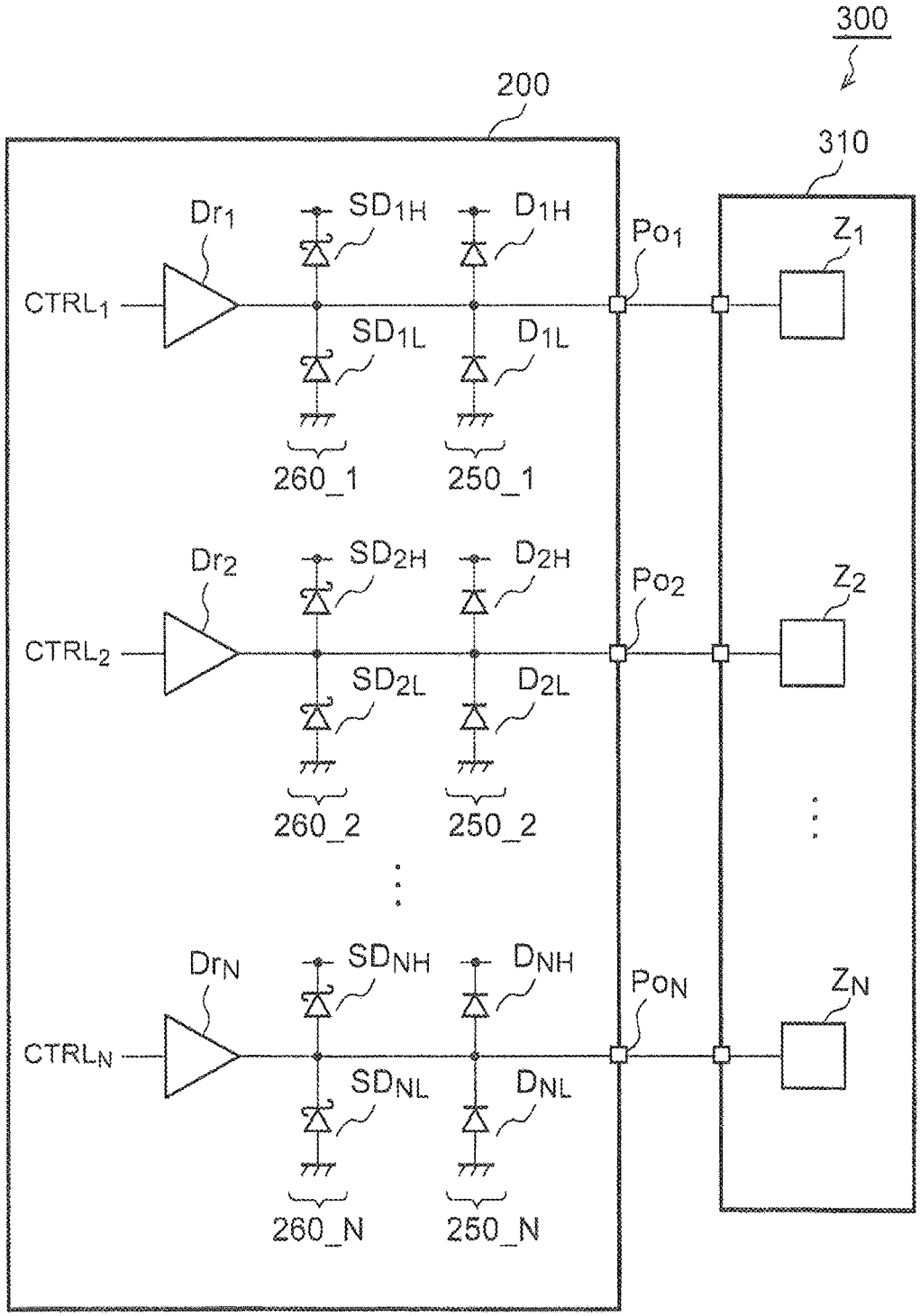
FIG. 4 is a circuit diagram of a driver circuit according to embodiment 1.

FIG. 4 shows a circuit diagram of a driver circuit 200 according to embodiment 1. The driver circuit 200 includes N channels of N outputs so as to drive N load devices (to be referred to load devices) $Z_1$ to $Z_N$. The driver circuit 200 includes a plurality of output terminals $Po_1$ to $PO_N$, a plurality of drivers $Dr_1$ to $Dr_N$, a plurality of protection circuits 250_1 to 250_N, and a plurality of clamp circuits 260_1 to 260_N, and is integrated on a function integrated circuit (IC) on a semiconductor substrate.

The driver circuit 200 forms a system 300 jointly with a load circuit 310 and a main processor that is not shown in the drawing.

The load circuit 310 includes N load devices $Z_1$ to $Z_N$. For example, the load device Z is a transistor, a piezoelectric device, a light emitting diode (LED) or a thermistor.

The plurality of output terminals $Po_1$ to $PO_N$ are connected to the plurality of load devices $Z_1$ to $Z_N$. The plurality of drivers $Dr_1$ to $Dr_N$ correspond to the plurality of output terminals $Po_1$ to $PO_N$. The output of the driver $Dr_\#$ (where #=1 to N)) is connected to the corresponding load device $Z_\#$ through the corresponding output terminal $Po_\#$. The driver $Dr_\#$ generates a driving signal $Vo_\#$ applied to the corresponding load device $Z_\#$ according to a control signal $CTRL_\#$ and outputs the driving signal $Vo_\#$ via the output terminal $Po_\#$. The driving signal $Vo_\#$ can be a voltage signal or a current signal. Controls signals $CTRL_1$ to $CTRL_N$ can be generated in the driver circuit 200, or can be provided externally to the driver circuit 200.

The plurality of protection circuits 250_1 to 250_N correspond to the plurality of output terminals $Po_1$ to $PO_N$. Each protection circuit 250_# includes a first diode $D_\#$ for protection against electrostatic discharge (ESD), wherein the first diode $D_\#$ is formed by PN junction. For example, an upper-side first diode $D_{\# H}$ is disposed between the output terminal $Po_\#$ and a power line, and a lower-side first diode $D_{\# L}$ is disposed between the output terminal $Po_\#$ and a ground line.

The plurality of clamp circuits 260_1 to 260_N correspond to the plurality of drivers $Dr_1$ to $Dr_N$. Each clamp circuit 260_# includes a second diode $SD_\#$ connected to the output node (or the input node) of the corresponding driver $Dr_\#$. A forward voltage $Vf_2$ of the second diode $SD_\#$ is preferably smaller than a forward voltage $Vf_1$ of the first diode $D_\#$ and is high-speed (having a shorter recovery time), and from such perspective, the second diode $SD_\#$ is preferably implemented by a Schottky diode ($Vf_1$=0.7V, and $Vf_2$=0.1V).

For example, the clamp circuit 260_# includes: an upper-side second diode $SD_{\# H}$, disposed between the output node of the driver $Dr_\#$ and the power line; and a lower-side second diode $SD_{\# L}$, disposed between the output node of the driver $Dr_\#$ and the ground line.

Figure 5A:
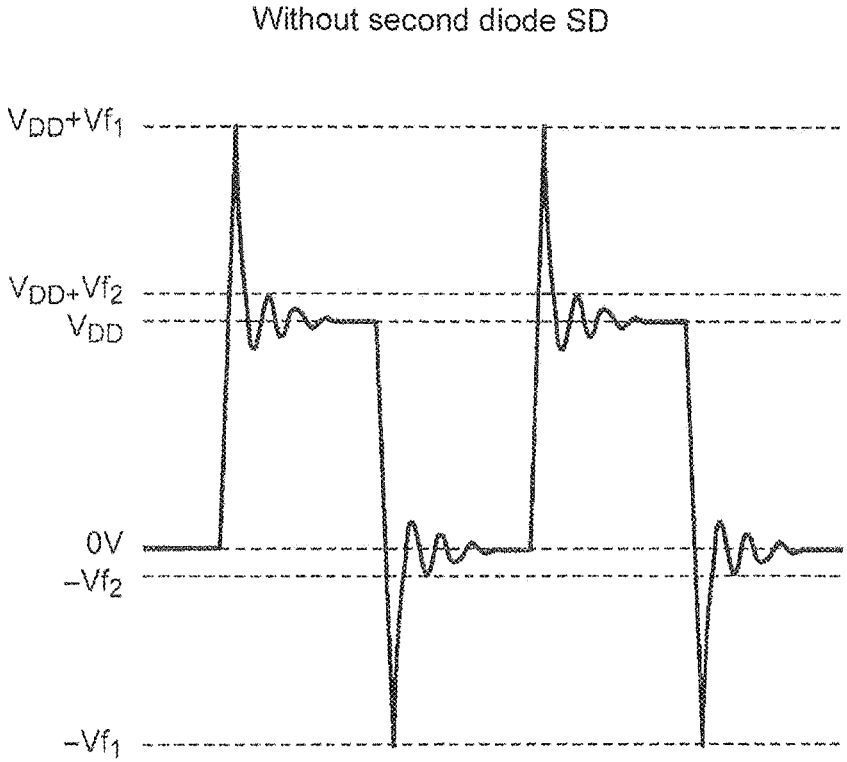
FIGS. 5(*a*) and (*b*) are diagrams illustrating actions of the driver circuit in FIG. 4.
Figure 5B:
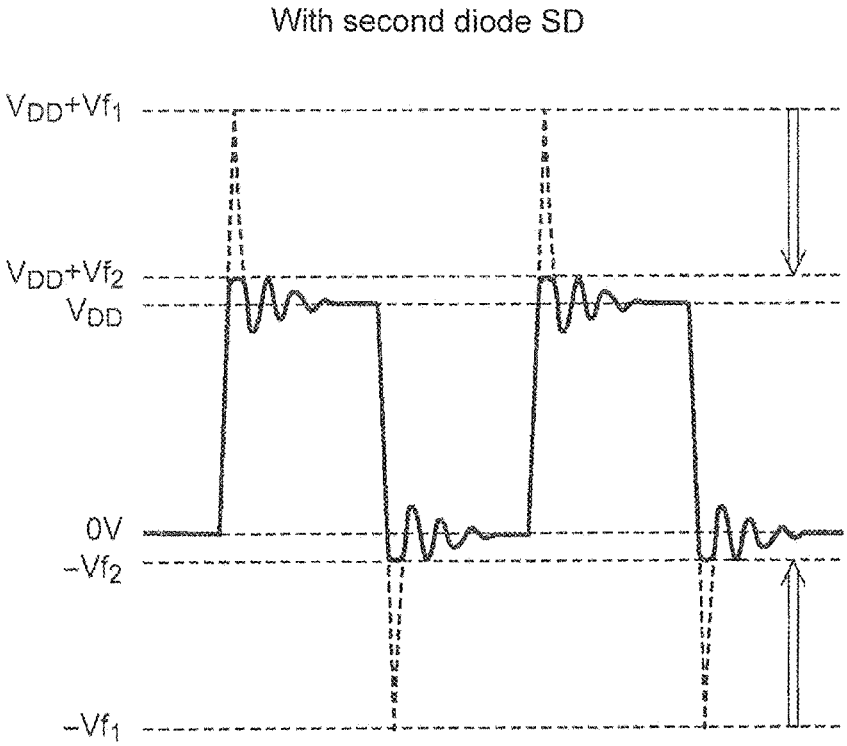

The structure of the driver circuit 200 is described below. Refer to FIGS. 5(*a*) and (*b*) for description on the actions of the driver circuit 200. For comparison, the waveforms of the actions of the second diodes $SD_1$ to $SD_N$ are omitted from FIG. 5(*a*), and the actions of the driver circuit 200 in FIG. 4 are shown in FIG. 5(*b*). It is assumed that abnormality has occurred in the load impedance in a channel $CH_\#$. The abnormality in the load impedance brings ringing to a potential $Vo_\#$ of the output terminal $Po_\#$ of the channel $CH_\#$. Given that only the first diode $D_\#$ for ESD protection is present, the upper-side first diode $D_{\# H}$ is caused to be conducted by the voltage $Vo_\#$ exceeding $V_{DD}+Vf_1$, and is thus clamped at $V_{DD}+Vf_1$. Further, the lower-side first diode $D_{\# L}$ is caused to be conducted by a voltage lower than $-Vf_1$, and is thus clamped at $-Vf_1$. That is to say, as shown in FIG. 5(*a*), the potential $Vo_\#$ of the output terminal $Po_\#$ varies within a range of $Vf_1$ to $V_{DD}+Vf_1$.

In contrast, given that the second diode $SD_\#$ is disposed, the upper-side second diode $SD_{\# H}$ is caused to be conducted by the voltage $Vo_\#$ exceeding $V_{DD}+Vf_2$, and is thus clamped at $V_{DD}+Vf_2$. Further, the lower-side second diode $SD_{\# L}$ is caused to be conducted by a voltage lower than $-Vf_2$, and is thus clamped at $-Vf_2$. The result is that, as shown in FIG. 5(*b*), the potential $Vo_\#$ of the output terminal $Po_\#$ is limited within the range of $-Vf_2$ to $V_{DD}+Vf_2$, which has a reduced range compared to the situation without the second diode. Therefore, overvoltage and ringing can be suppressed.

In another approach, a structure (a comparison technology) in which a Schottky diode is externally provided for each output terminal Po of the driver circuit 200 is considered. In embodiment 1, the second diodes $SD_1$ to $SD_N$ are integrated on the semiconductor chip of the driver circuit 200, and the installation area and costs of the circuit can be significantly reduced compared to the comparison technology.

In addition, in the comparison technology, the physical distance between a node (to be referred to as a protected node) at which overvoltage and ringing should be suppressed and the Schottky diode is increased, and the influence of the parasitic impedance between the protected node and the Schottky diode is also increased, such that the voltage clamping effect of the Schottky diode is limited. In comparison, in embodiment 1, the distance between the protected node and the second diode $SD_\#$ can be reduced and the parasitic impedance therebetween can be accordingly decreased, such that the effects of suppressing overvoltage and ringing for the second diode $SD_\#$ can be maximized.

Embodiment 1.1

Figure 6:
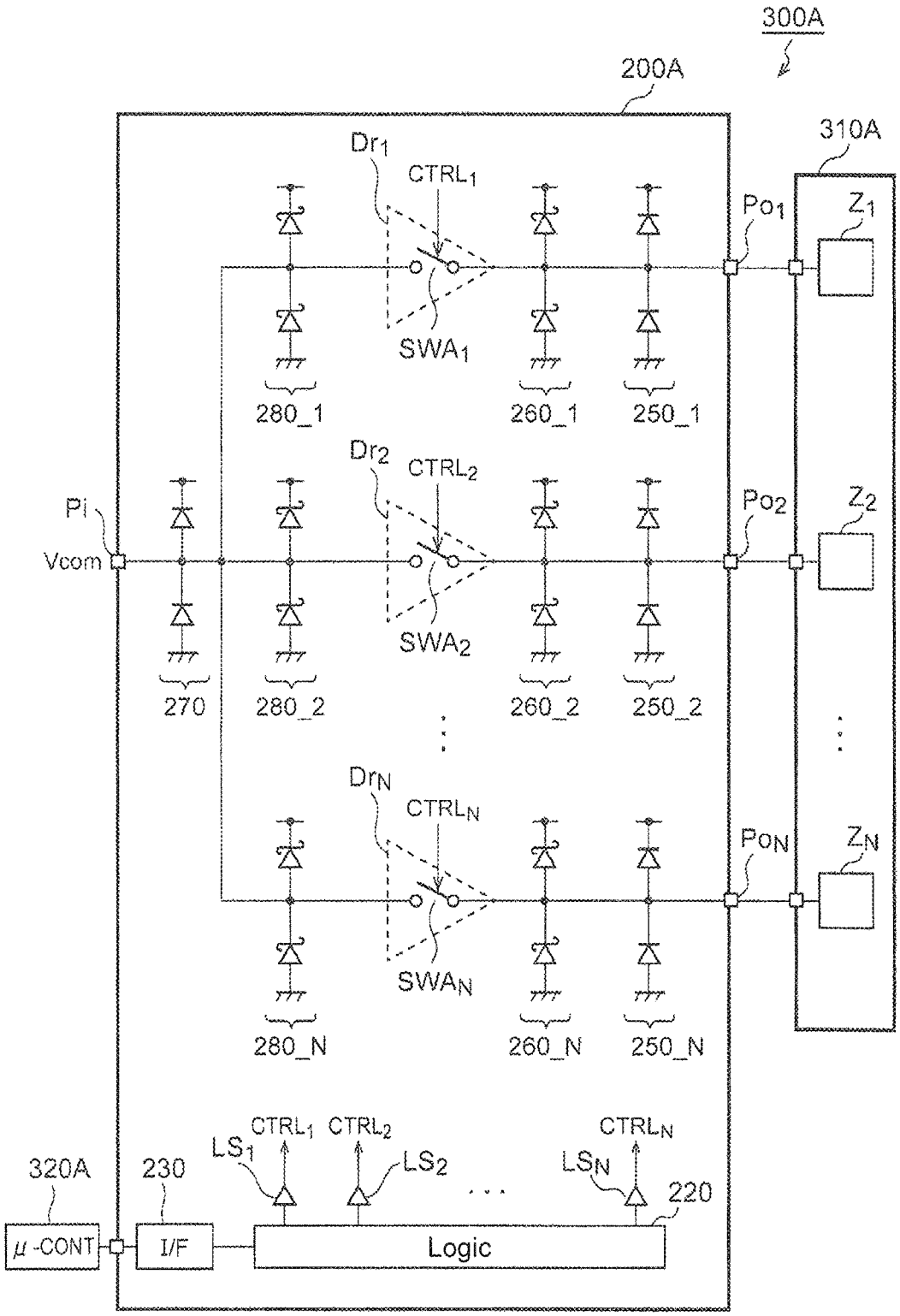
FIG. 6 is a circuit diagram of a specific exemplary structure (embodiment 1.1) of the driver circuit according to embodiment 1.

FIG. 6 shows a circuit diagram of a specific exemplary structure of a driver circuit (embodiment 1.1, denoted as 200A) according to embodiment 1. The driver circuit 200A is a switch-type driver, and is capable of enabling the output terminal Po of any channel to generate an input voltage Vcom supplied to an input terminal Pi. For example, the driver circuit 200A is a printer driver, and the driver circuit 200A and a load circuit 310A serving as a print head jointly form a printer system 300A.

A driver Dr of each channel includes an analog switch SWA, and the state of each analog switch $SWA_\#$ (where #=1 to N) is controlled by a corresponding control signal $CTRL_\#$.

When the analog switch $SWA_\#$ is conducted, the input terminal Pi and the output terminal $Po_\#$ are conducted, and the input signal Vcom is present in the output terminal $Po_\#$.

The driver circuit 200A includes a plurality of level shifters $LS_1$ to $LS_N$, a signal processing portion 220, and an interface circuit 230. The interface circuit 230 receives from a main processor 320A data for controlling outputs of the channels. The signal processing portion 220 is a logic circuit, and generates control signals $CTRL_1$ to $CTRL_N$ based on the data received by the interface circuit 230. Each level shifter $LS_\#$ receives the control signal $CTRL_\#$ of the corresponding channel, converts the control signal $CTRL_\#$ to an appropriate voltage level, and drives the corresponding analog switch $SWA_\#$.

In embodiment 1.1, an ESD protection circuit 250_# is connected to each output terminal $Po_\#$, and an ESD protection circuit 270 is connected to the common input terminal Pi. The protection circuit 270 can have a same structure as the protection circuit 250.

Further, in embodiment 1.1, a clamp circuit 280_# is disposed on an input side of each driver $Dr_\#$. The clamp circuit 280_# includes a diode having a forward voltage smaller than that of the protection circuit 270. The structure of the clamp circuit 280_# can be the same as that of the clamp circuit 260_#, and can include a Schottky diode.

When the driver Dr includes the analog switch SWA, the effects of suppressing overvoltage and ringing can be further enhanced by using the clamp circuit 280_# disposed on the input side.

Figure 7A:
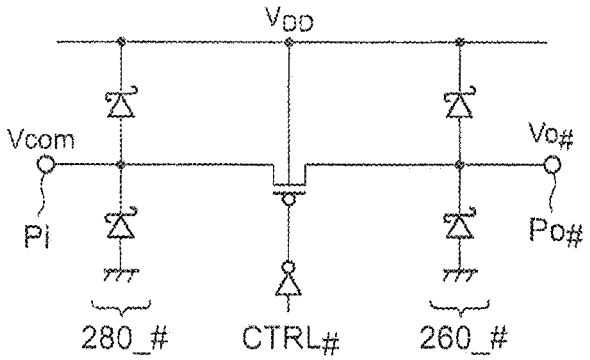
FIGS. 7(*a*) to (*c*) are circuit diagrams of exemplary structures of an analog switch.
Figure 7B:
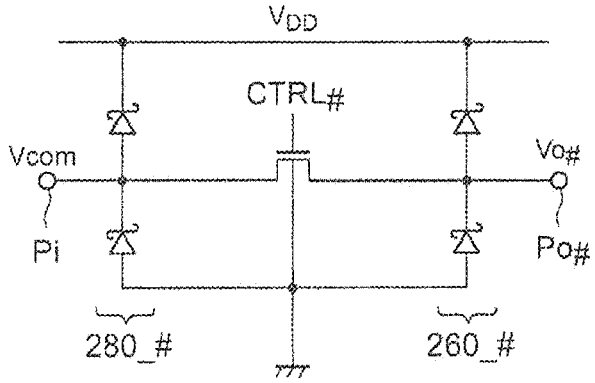
Figure 7C:
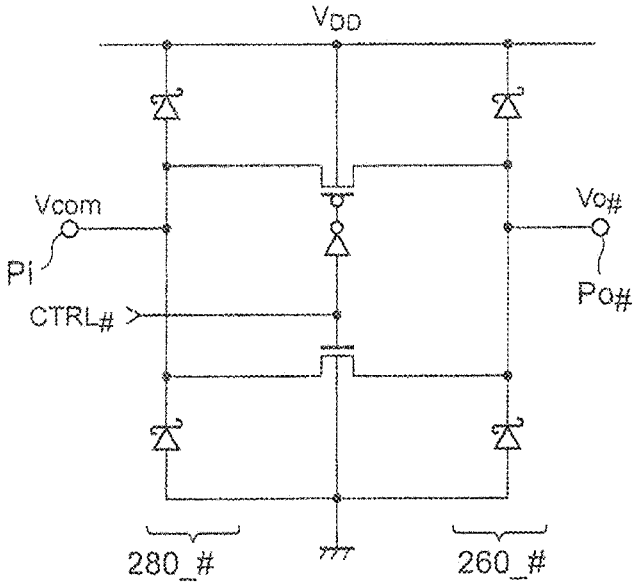

FIGS. 7(*a*) to (*c*) are circuit diagrams of exemplary structures of the analog switch SWA. The analog switch SWA in FIG. 7(*a*) includes a P-channel metal-oxide-semiconductor (PMOS) transistor, which has its back gate connected to a power line $V_{DD}$. The analog switch SWA in FIG. 7(*b*) includes an N-channel metal-oxide-semiconductor (NMOS) transistor, which has its back gate grounded. The analog switch SWA in FIG. 7(*c*) is formed by a pair of NMOS transistor and PMOS transistor. The structure of the analog switch SWA is designed according to the signal level (the voltage range) of the input signal Vcom.

Embodiment 1.2

Figure 8:
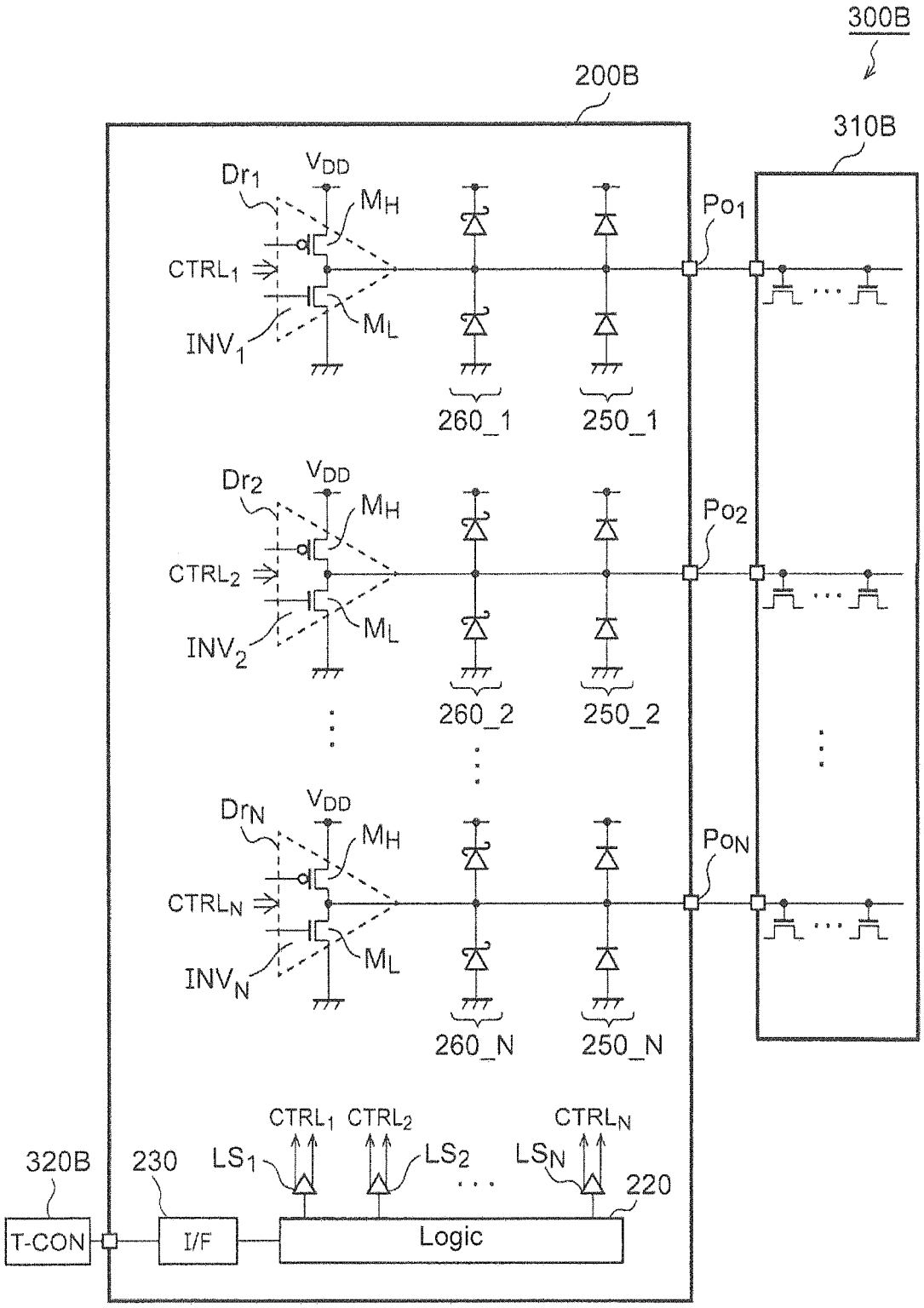
FIG. 8 is a circuit diagram of a specific exemplary structure (embodiment 1.2) of the driver circuit according to embodiment 1.

FIG. 8 shows a circuit diagram of a specific exemplary structure of a driver circuit (embodiment 1.2, denoted as 200B) according to embodiment 1. The driver circuit 200B is a binary driver selectively outputting two values including a high-level voltage and a low-level voltage to the output terminal Po of each channel. For example, the driver circuit 200B is a gate driver, and the driver circuit 200B and a load circuit 310B serving as a display panel jointly form a display system 300B.

The driver Dr of each channel includes an inverter INV capable of outputting two values including a high-level voltage and a low-level voltage. The state of each inverter $INV_{\#}$ (where #=1 to N) is controlled by a corresponding control signal $CTRL_{\#}$.

The inverter INV includes a high-side transistor $M_H$ and a low-side transistor $M_L$. When the control signal $CTRL_{\#}$ is a first level (e.g., a high voltage), the high-side transistor $M_H$ is conducted and the low-side transistor $M_L$ is disconnected, and a high-level voltage $V_{DD}$ is generated in the output terminal $Po_{\#}$. When the control signal $CTRL_{\#}$ is a second level (e.g., a low voltage), the high-side transistor $M_H$ is disconnected and the low-side transistor $M_L$ is conducted, and a low-level voltage 0V is generated in the output terminal $Po_{\#}$.

The driver circuit 200B includes a plurality of level shifters $LS_1$ to $LS_N$, a signal processing portion 220, and an interface circuit 230. The interface circuit 230 receives a synchronization signal (a control signal) from a timing controller 320B. The signal processing portion 220 is a logic circuit, and generates control signals $CTRL_1$ to $CTRL_N$ based on the synchronization signal received by the interface circuit 230. Each level shifter $LS_{\#}$ receives the control signal $CTRL_{\#}$ of the corresponding channel, converts the control signal $CTRL_{\#}$ to an appropriate voltage level, and drives the corresponding inverter $INV_{\#}$.

The driver circuit 200B includes a clamp circuit 260_# connected to the output node of each driver Dr (the inverter INV).

Embodiment 1.3

Figure 9:
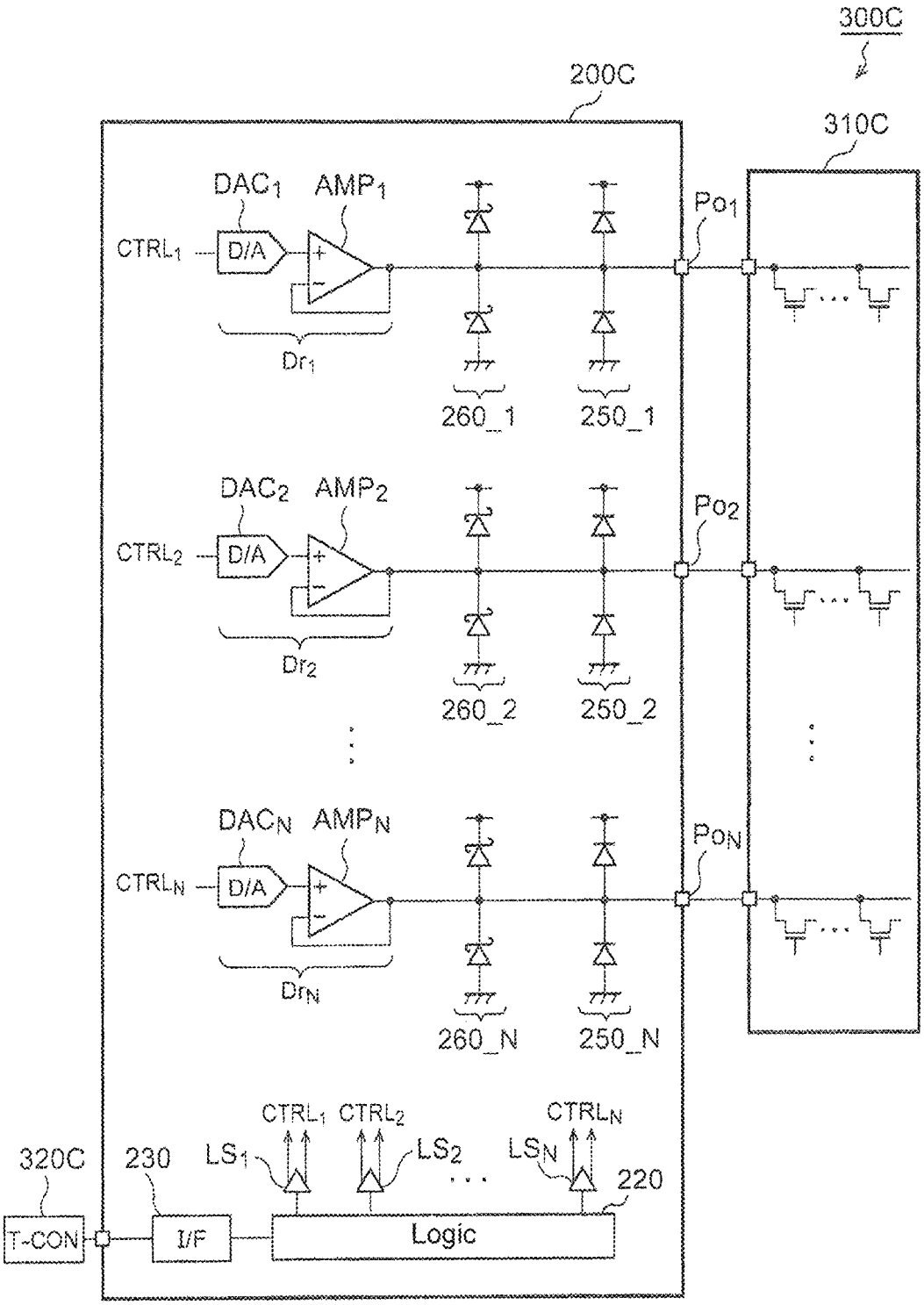
FIG. 9 is a circuit diagram of a specific exemplary structure (embodiment 1.3) of the driver circuit according to embodiment 1.

FIG. 9 shows a circuit diagram of a specific exemplary structure of the driver circuit (embodiment 1.3, denoted as 200C) according to embodiment 1. The driver circuit 200C enables the output terminal Po of each channel to generate a multi-value driving signal.

For example, the driver circuit 200C is a source driver, and the driver circuit 200C and a load circuit 310C serving as a display panel jointly form a display system 300C.

The driver $Dr_{\#}$ of each channel includes an amplifier (a buffer) $AMP_{\#}$ capable of outputting any voltage level and a digital-to-analog converter (DAC) $DAC_{\#}$. The DAC $DAC_{\#}$ converts a digital control signal (brightness data) $CTRL_{\#}$ to an analog control signal, and provides the analog control signal to the amplifier $AMP_{\#}$. The output level of each amplifier $AMP_{\#}$ (where #=1 to N) is controlled by a corresponding control signal $CTRL_{\#}$.

The driver circuit 200C includes a plurality of level shifters $LS_1$ to $LS_N$, a signal processing portion 220, and an interface circuit 230. The interface circuit 230 receives image data from the timing controller 320B. The signal processing portion 220 is a logic circuit, and generates, based on image signals received by the interface circuit 230, control signals $CTRL_1$ to $CTRL_N$ indicating brightness of individual pixels. Each level shifter $LS_{\#}$ receives the control signal $CTRL_{\#}$ of the corresponding channel, converts the control signal $CTRL_{\#}$ to an appropriate voltage level, and provides the voltage level to the corresponding DAC $DAC_{\#}$.

The driver 200C includes clamp circuits 260_# connected to the output nodes of the drivers Dr (the amplifiers AMP).

Embodiment 2

Figure 10:
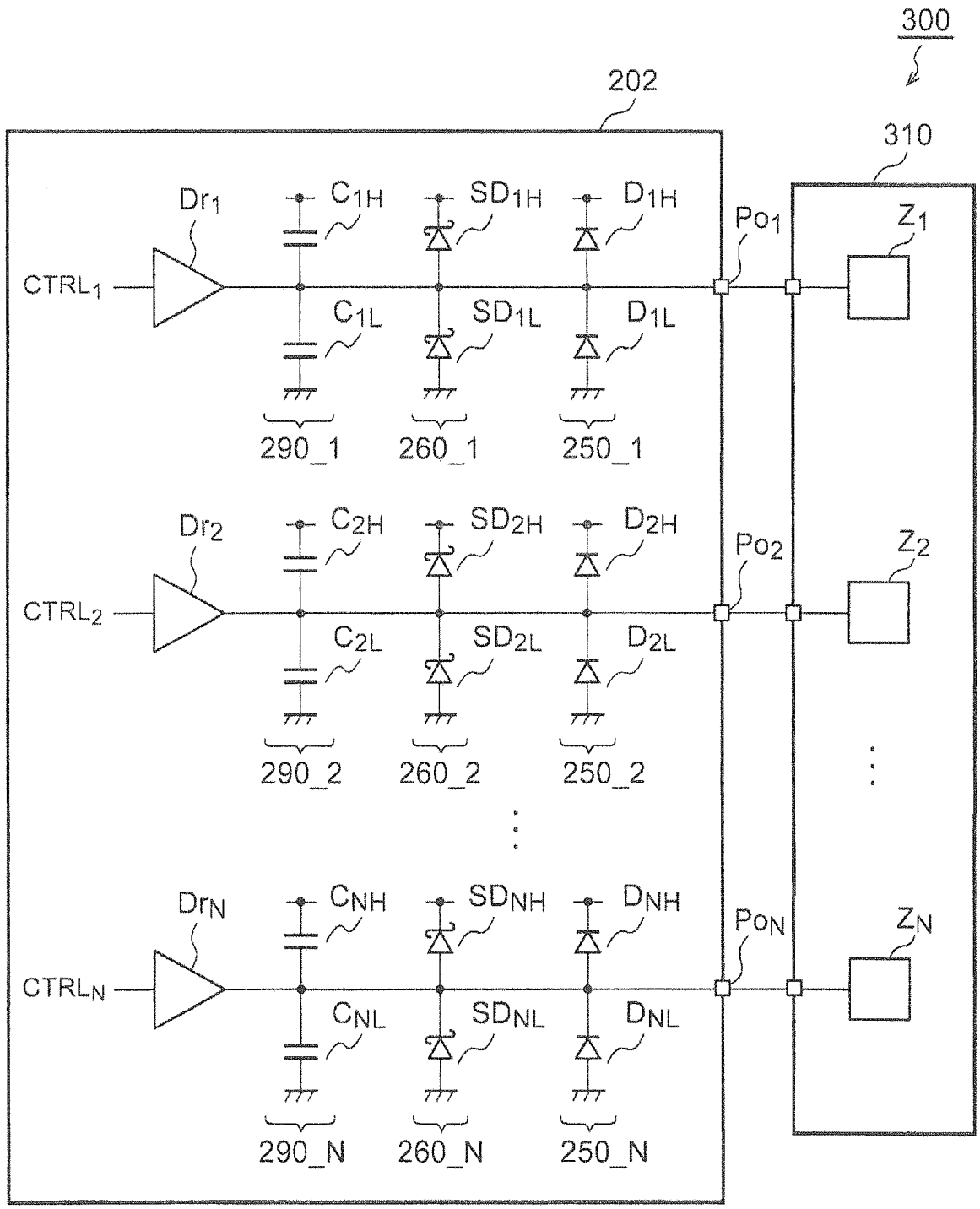
FIG. 10 is a circuit diagram of a driver circuit according to embodiment 2.

FIG. 10 shows a circuit diagram of a driver circuit 202 according to embodiment 2. The fundamental structure of the driver circuit 202 is the same as that of the driver circuit in FIG. 4. The driver circuit 202 further includes a plurality of bypass circuits 290_1 to 290_N.

The plurality of bypass circuits 290_1 to 290_N correspond to a plurality of drivers $Dr_1$ to $Dr_N$. Each bypass circuit 290_# includes a capacitor $C_{\#}$ connected to an output node (or an input node) of the corresponding driver $Dr_{\#}$. The bypass circuit 290_# releases high-frequency noise inputted by the corresponding output terminal $Po_{\#}$ to a power line or a ground line. Therefore, the capacitance of the capacitor $C_{\#}$ only needs to be set as being low enough impedance in the frequency band of the high-frequency noise.

For example, the bypass circuit 290_# includes: an upper-side capacitor $C_{\# H}$, disposed between the output node of the driver $Dr_{\#}$ and the power line; and a lower-side capacitor $C_{\# L}$, disposed between the output node of the driver $Dr_{\#}$ and the ground line.

Figure 11:
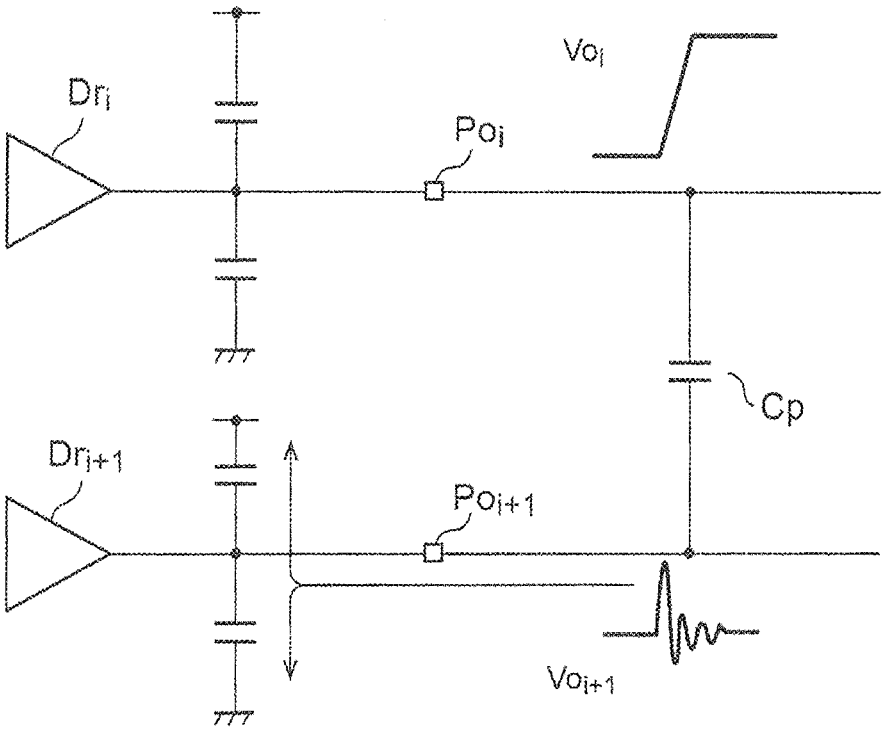
FIG. 11 is a diagram illustrating actions of the driver circuit in FIG. 10.

The above is the structure of the driver circuit 202. Actions of the driver circuit 202 are to be described below. FIG. 11 shows a diagram of actions of the driver circuit 202 in FIG. 10. In FIG. 11, two channels $CH_i$ and $CH_{i+1}$ that are adjacent are depicted, and the two channels $CH_i$ and $CH_{i+1}$ are coupled by a capacitor Cp.

When the voltage $Vo_i$ of the lines of the channel $CH_i$ is transferred, the high-frequency component therein invades the line of the other channel $CH_{i+1}$ through the capacitor Cp, resulting in a main factor causing malfunction or quality degradation. The bypass circuit 290_(i+1) is capable of releasing the high-frequency noise invaded through the capacitor Cp to the power line or the ground line. Therefore, the change in the potential $Vo_{i+1}$ of the other channel $CH_{i+1}$ can be suppressed.

In embodiment 2, the structure of the driver Dr is the same as those in the description associated with embodiments 1.1 to 1.3, and can be implemented by various forms.

Embodiment 2.1

Figure 12:
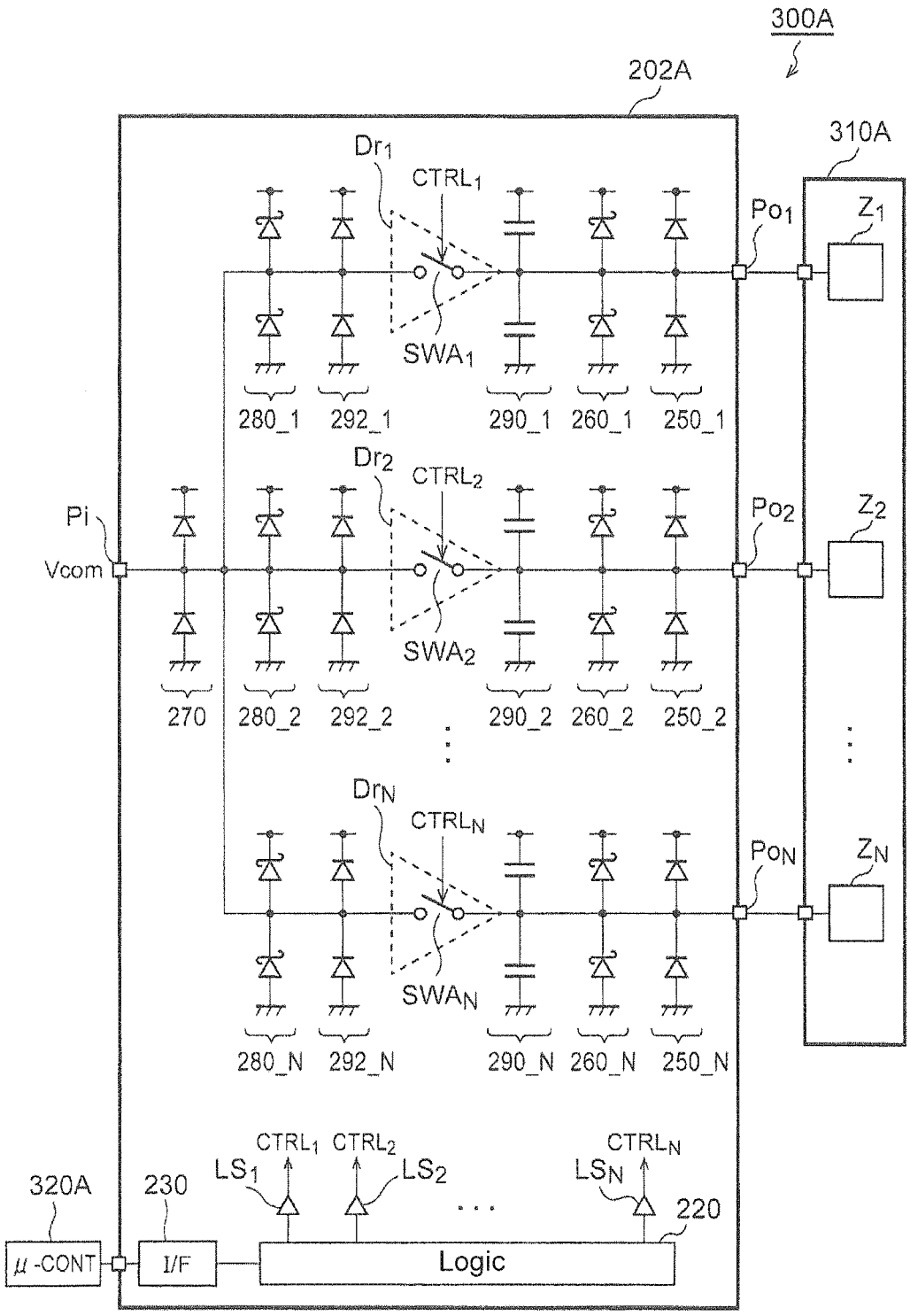
FIG. 12 is a circuit diagram of a specific exemplary structure (embodiment 2.1) of the driver circuit according to embodiment 2.

FIG. 12 shows a circuit diagram of a specific exemplary structure of the driver circuit (embodiment 2.1, denoted as 202A) according to embodiment 2. The driver circuit 202A is the same as that in embodiment 1.1 (FIG. 6) and is a switch-type driver capable of enabling the output terminal Po of any channel to generate the input voltage Vcom provided to the input terminal Pi. The driver Dr of each channel includes an analog switch SWA, and the state of each analog switch $SWA_{\#}$ (where #=1 to N) is controlled by a corresponding control signal $CTRL_{\#}$.

In addition to the driver circuit 200A in FIG. 6, the driver circuit 202A further includes bypass circuits 290_1 to 290_N, and 292_1 to 292_N. The bypass circuit 290_# is disposed on an output side of the analog switch $SWA_{\#}$, and the bypass circuit 292_# is disposed on an input side of the analog switch $SWA_{\#}$.

In a situation where the driver Dr includes the analog switch SWA, the effects of noise suppression can be further enhanced by disposing the bypass circuit 292_# on the input side.

Figure 13A:
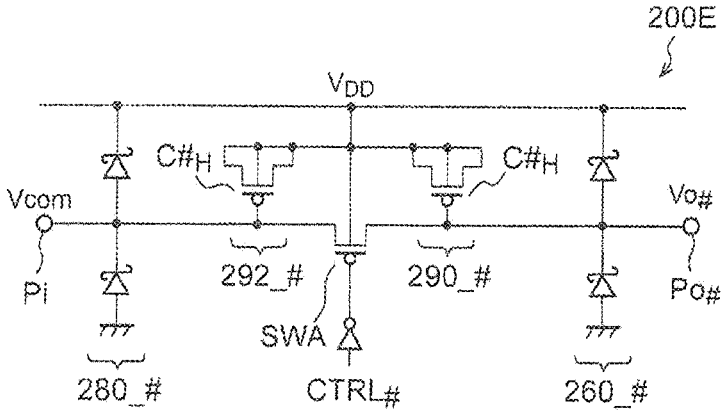
FIGS. 13(*a*) to (*c*) are circuit diagrams of exemplary structures of an analog switch and a bypass circuit.
Figure 13B:
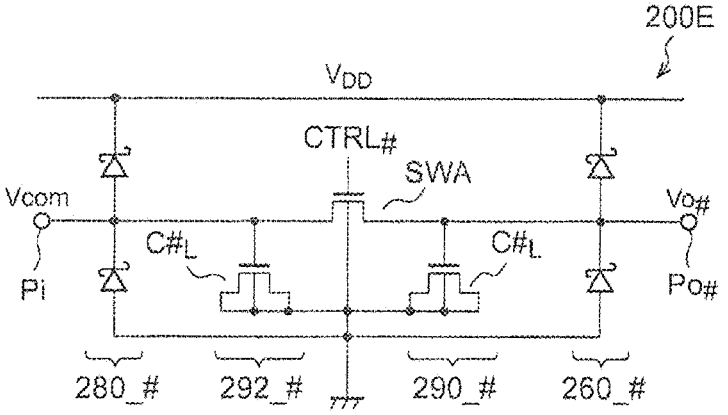
Figure 13C:
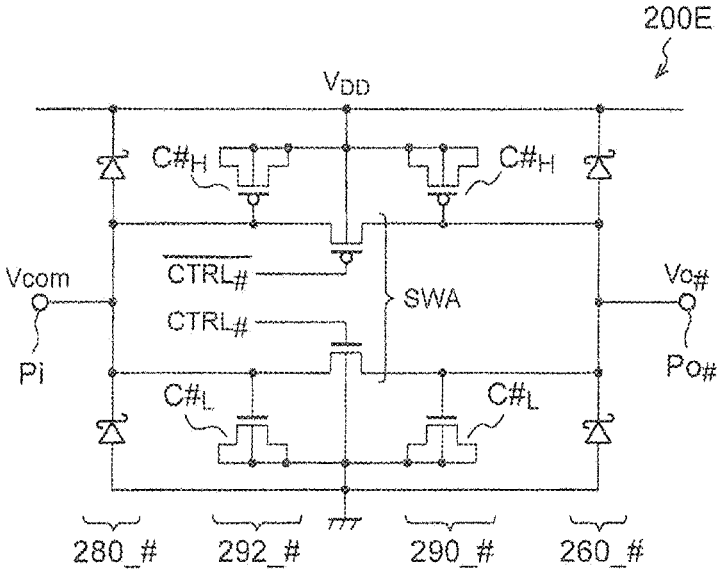

FIGS. 13(*a*) to (*c*) show circuit diagrams of exemplary structures of the analog switch SWA and the bypass circuits 290 and 292. The capacitor $C_{\#}$ forming the bypass circuits 290 and 292 can include a gate capacitor of a metal-oxide-semiconductor (MOS) transistor. More specifically, the back gate, drain and source of a MOS transistor are connected to a ground line (or a power line), and the gate is connected to the input or the output of the analog switch SWA.

Further, the structure of the capacitor $C_{\#}$ of the bypass circuits 290 and 292 is not limited, and a metal-insulator-metal (MIM) structure can also be used.

Embodiment 2.2

Figure 14:
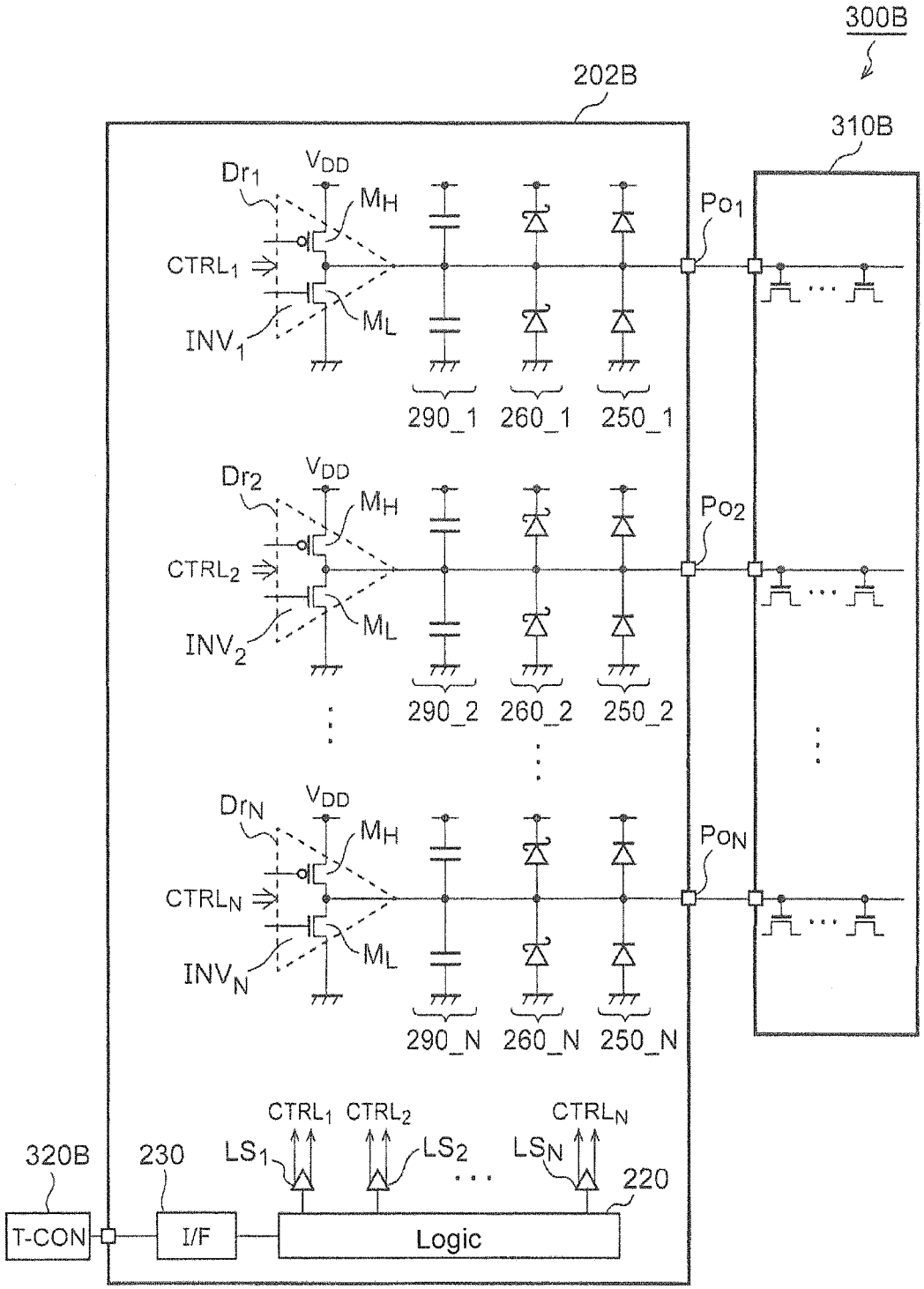
FIG. 14 is a circuit diagram of a specific exemplary structure (embodiment 2.2) of the driver circuit according to embodiment 2.

FIG. 14 shows a circuit diagram of a specific exemplary structure of the driver circuit (embodiment 2.2, denoted as 202B) according to embodiment 2. The driver circuit 202B is the same as that in embodiment 1.2 (FIG. 8), and is a binary driver that selectively outputs two values including a high-level voltage and a low-level voltage to the output terminal Po of each channel.

The driver Dr of each channel includes an inverter INV capable of outputting two values including a high-level voltage and a low-level voltage. The state of each inverter $INV_{\#}$ (where #=1 to N) is controlled according to a corresponding control signal $CTRL_{\#}$.

In addition to the driver circuit 200B in FIG. 8, the driver circuit 202B further includes bypass circuits 290_1 to 290_N. The bypass circuit 290_# includes a capacitor connected to an output node of the inverter $INV_{\#}$.

Embodiment 2.3

Figure 15:
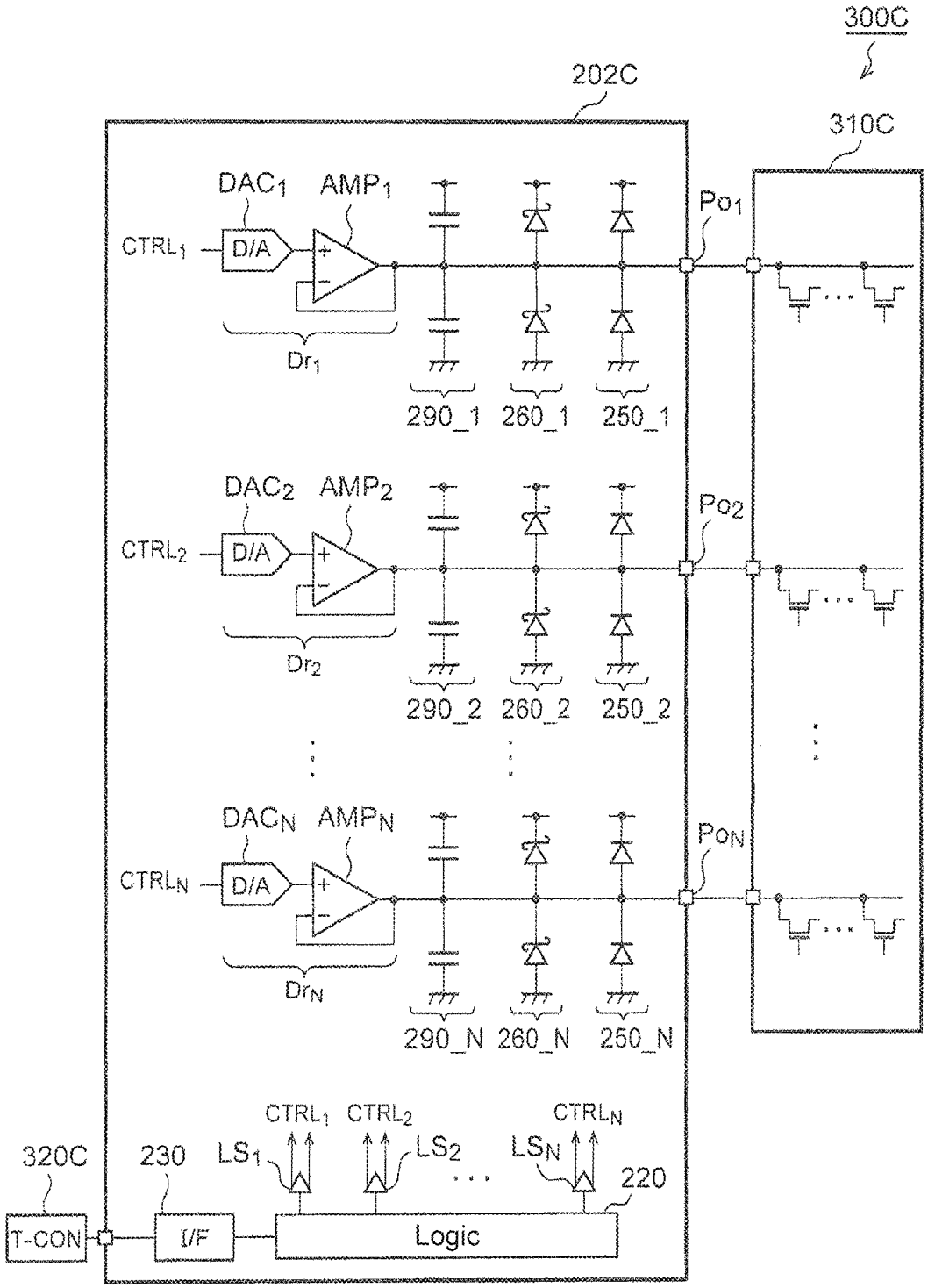
FIG. 15 is a circuit diagram of a specific exemplary structure (embodiment 2.3) of the driver circuit according to embodiment 2.

FIG. 15 shows a circuit diagram of a specific exemplary structure of the driver circuit (embodiment 2.3, denoted as 202C) according to embodiment 2. The driver circuit 202C enables the output terminal Po of each channel to generate multi-value driving signals.

The driver $Dr_{\#}$ of each channel includes an amplifier (a buffer) $AMP_{\#}$ capable of outputting any voltage level, and a digital-to-analog converter (DAC) $DAC_{\#}$. The DAC $DAC_{\#}$ converts a digital control signal (brightness data) $CTRL_{\#}$ to an analog control signal, and provides the analog signal to the amplifier $AMP_{\#}$. The output level of each amplifier $AMP_{\#}$ (where #=1 to N) is controlled by a corresponding control signal $CTRL_{\#}$.

In addition to the driver circuit 200C in FIG. 9, the driver circuit 202C further includes bypass circuits 290_1 to 290_N. The bypass circuit 290_# includes a capacitor connected to an output node of the amplifier $AMP_{\#}$.

(Layout)

Figure 16:
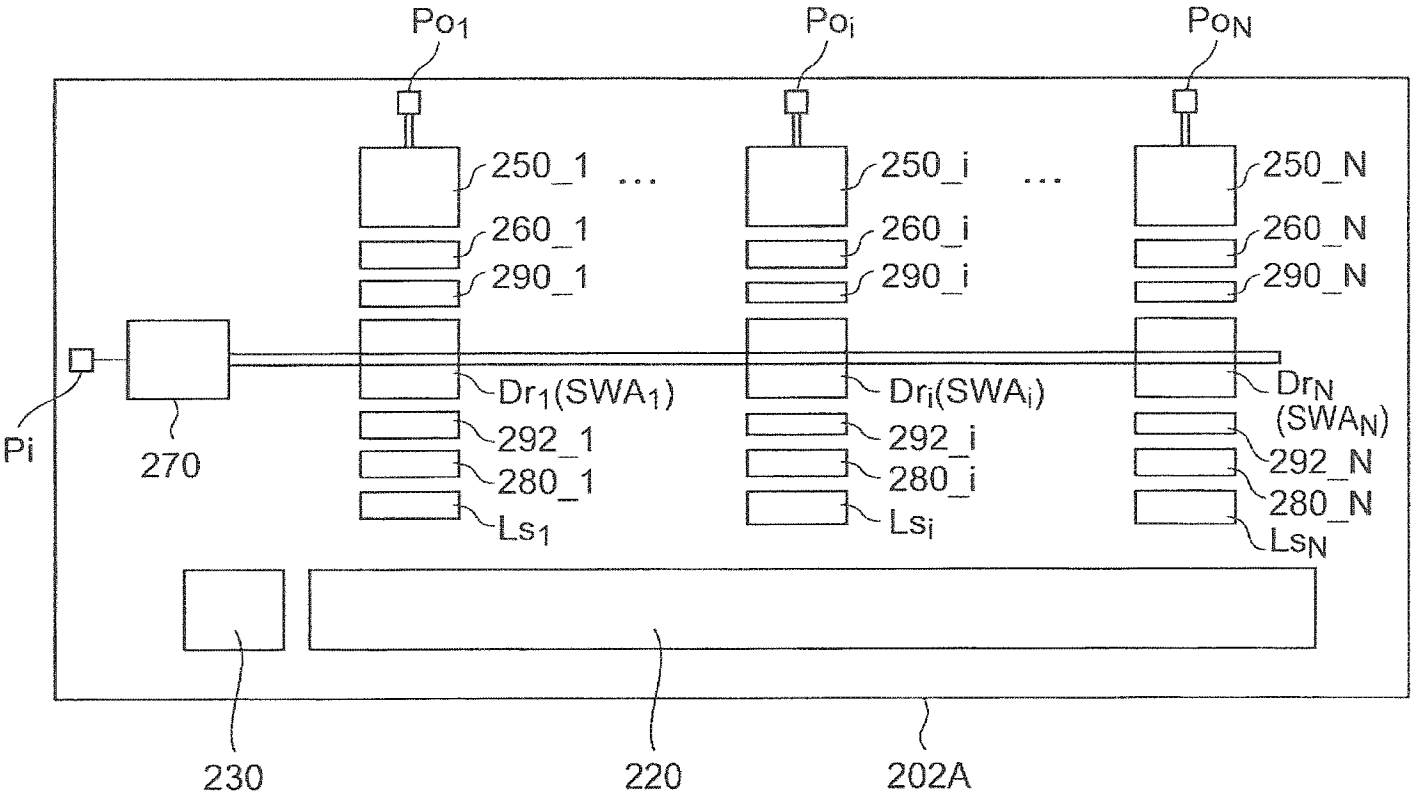
FIG. 16 is a layout diagram of the driver circuit in FIG. 12.

FIG. 16 shows a layout diagram of the driver circuit 202A in FIG. 12. The driver circuit 202A is accommodated in a package having a first direction (x direction) as lengthwise and a second direction (y direction) as widthwise. The plurality of output terminals $Po_1$ to $PO_N$ are disposed and aligned along an edge E1 extending in the first direction. The protection circuit 250_*i* is closed to corresponding output terminal $Po_i$ disposed in an input/output (I/O) region on the outer periphery of the chip. The clamp circuit 260_*i*, the bypass circuit 290_*i*, the driver $Dr_i$ (the analog switch $SWA_i$), the bypass circuit 292_*i*, the clamp circuit 280_*i* and the level shifter LS corresponding to one output terminal $Po_i$ are disposed and aligned in the second direction.

The driver circuit 200A in FIG. 6 is designed such that the layout of the bypass circuits 290_1 to 290_N and 292_1 to 292_N in FIG. 16 can be omitted.

Figure 17:
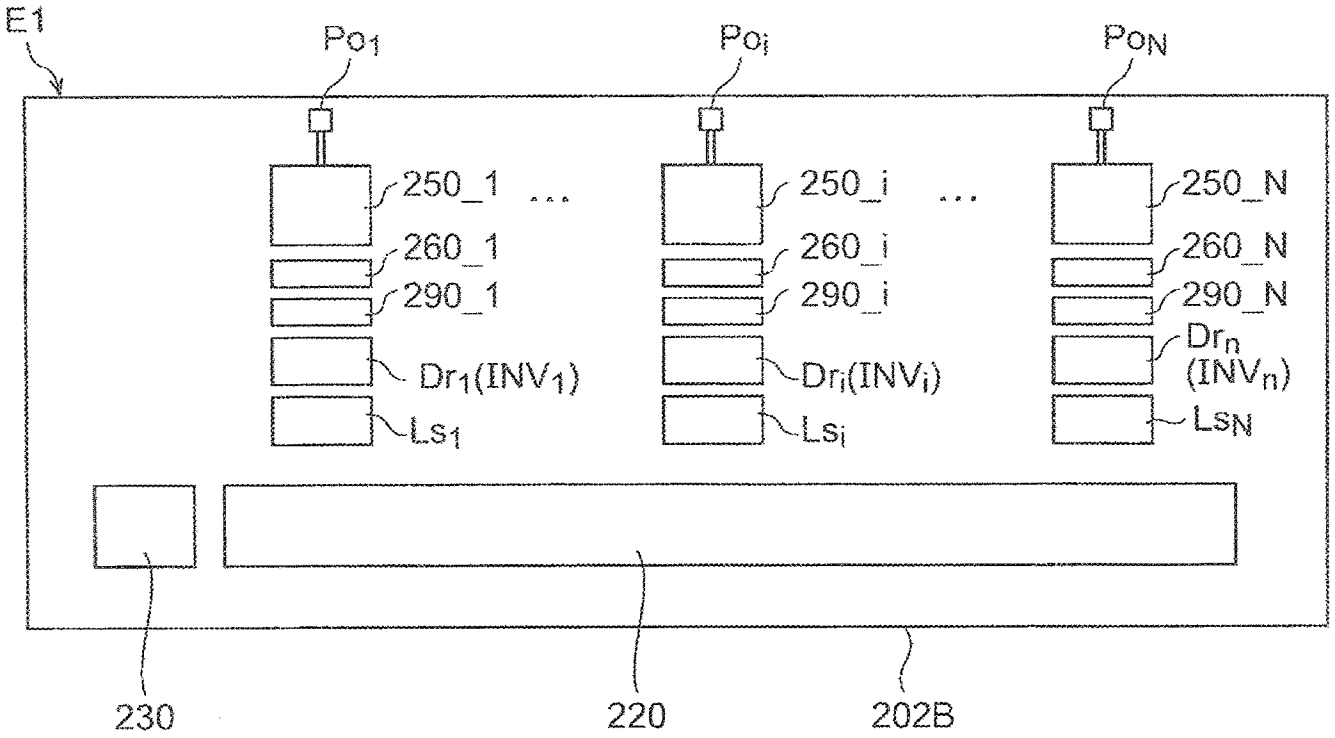
FIG. 17 is a layout diagram of the driver circuit in FIG. 14.

FIG. 17 shows a layout diagram of the driver circuit 202B in FIG. 14. The driver circuit 202B is accommodated in a package having a first direction (x direction) as lengthwise and a second direction (y direction) as widthwise. The plurality of output terminals $Po_1$ to $PO_N$ are disposed and aligned along an edge E1 extending in the first direction. The protection circuit 250_*i* is closed to corresponding output terminal $Po_i$ disposed in an I/O region on the outer periphery of the chip. The clamp circuit 260_*i*, the bypass circuit 290_*i*, the driver $Dr_i$ (the inverter $INV_i$) and the level shifter $LS_i$ corresponding to one output terminal $Po_i$ are disposed and aligned in the second direction.

The driver circuit 200B in FIG. 8 is designed such that the layout of the bypass circuits 290_1 to 290_N in FIG. 17 can be omitted.

Figure 18:
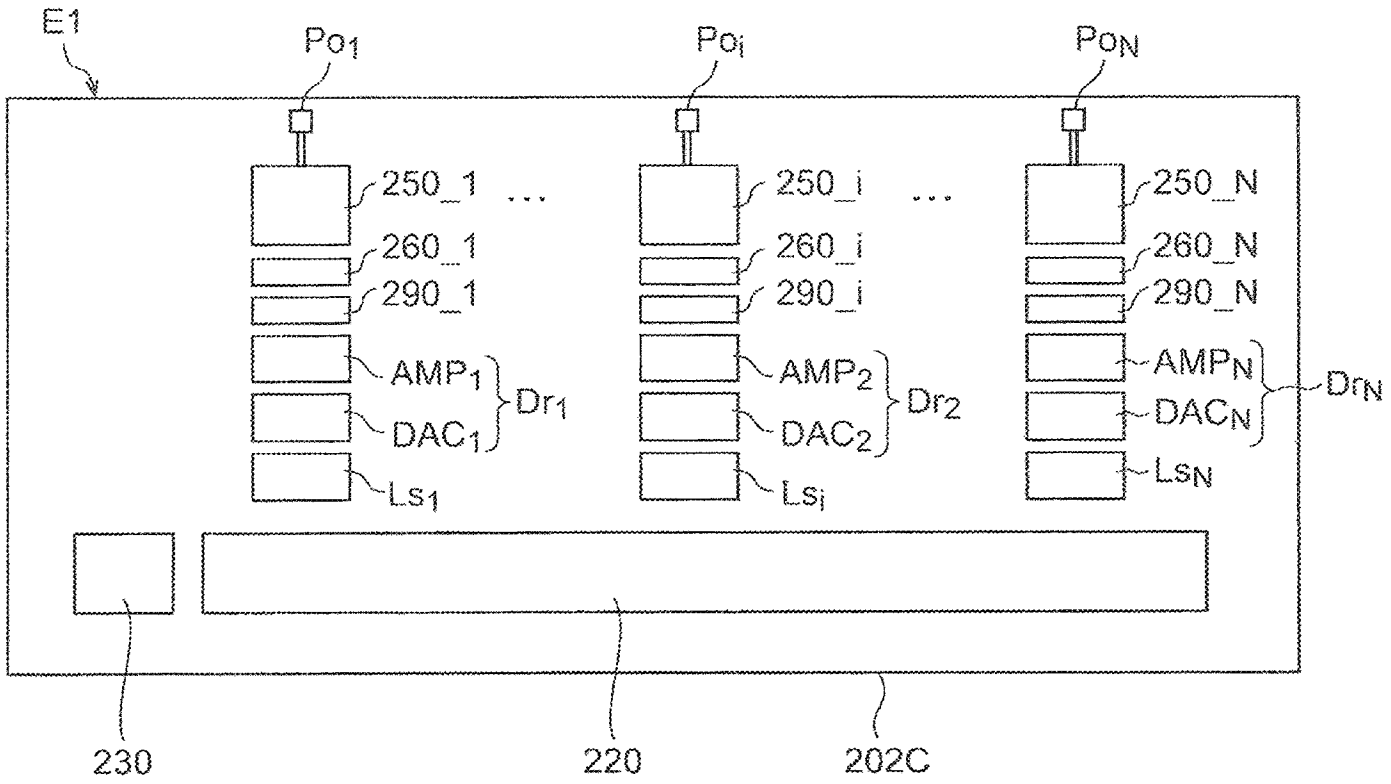
FIG. 18 is a layout diagram of the driver circuit in FIG. 15.

FIG. 18 shows a layout diagram of the driver circuit 202C in FIG. 15. The driver circuit 202C is accommodated in a package having a first direction (x direction) as lengthwise and a second direction (y direction) as widthwise. The plurality of output terminals $Po_1$ to $PO_N$ are disposed and aligned along an edge E1 extending in the first direction. The protection circuit 250_*i* is closed to corresponding output terminal $Po_i$ disposed in an I/O region on the outer periphery of the chip. The clamp circuit 260_*i*, the bypass circuit 290_*i*, the driver $Dr_i$ (the amplifier $AMP_i$ and the DAC $DAC_i$) and the level shifter $LS_i$ corresponding to one output terminal $Po_i$ are disposed and aligned in the second direction.

The driver circuit 200C in FIG. 9 is designed such that the layout of the bypass circuits 290_1 to 290_N in FIG. 18 can be omitted.

The present invention is described by way of the embodiments above. A person skilled in the art should understand that these embodiments are illustrative examples, and any combination of the constituents or processing steps can exist in numerous variations, which are also encompassed within the scope of the present invention. Some of the variations are described below.

The second diodes SD used in the clamp circuits 260 and 280 are not limited to being Schottky diodes, and other devices having a forward voltage Vf smaller than those of first diodes forming the protection circuits 250 and 270 can be used.

In embodiment 1, the structure of the clamp circuit 260 (280) is described. In embodiment 2, the structures of the clamp circuit 260 (280) and the bypass circuit 290 (292) are described. However, the present invention is not limited to the description above. For example, a structure merely having the bypass circuit 290 (292) as an implementation form of the present invention is also considered effective.

The present invention is described by way of the embodiments above. It should be noted that, the non-limiting embodiments merely express principles and applications of the present invention. Without departing from the conceptual range of the present invention as defined in the claims, numerous variations and configurations can be made to the embodiments.

What is claimed is:

1. A driver circuit, driving a plurality of load devices, the driver circuit comprising:

a plurality of output terminals, connected to the plurality of load devices;

a plurality of drivers, corresponding to the plurality of output terminals, generating driving signals applied to the respectively corresponding load devices; and a plurality of clamp circuits, corresponding to the plurality of drivers, comprising Schottky diodes connected to input nodes or output nodes of the respectively corresponding drivers;

wherein, the driver circuit is integrated on a semiconductor substrate, and each one of the drivers is respectively connected to each one of the corresponding load devices via each one of the corresponding clamp circuits.

2. The driver circuit according to claim 1, wherein each of the clamping circuit comprises:

an upper-side Schottky diode, provided between the input node or the output node of the corresponding driver and a power line; and a lower-side Schottky diode, provided between the input node or the output node of the corresponding driver and a ground line.

3. The driver circuit according to claim 1, further comprising:

a plurality of bypass circuits, corresponding to the plurality of drivers, comprising capacitors connected to the input nodes or the output nodes of the respectively corresponding drivers.

4. The driver circuit according to claim 3, wherein the capacitor is a gate capacitor of a metal-oxide-semiconductor (MOS) transistor.

5. The driver circuit according to claim 3, wherein each of the bypass circuits comprises:

an upper-side capacitor, provided between the input node or the output node of the corresponding driver and a power line; and a lower-side capacitor, provided between the input node or the output node of the corresponding driver and a ground line.

6. The driver circuit according to claim 1, wherein the driver circuit is in a package having a first direction as lengthwise and a second direction as widthwise;

the plurality of output terminals are disposed and aligned in the first direction; and the driver and the clamp circuit corresponding to one of the output terminals are disposed and aligned in the second direction.

7. The driver circuit according to claim 1, further comprising:

a plurality of protection circuits, corresponding to the plurality of output terminals, comprising protection diodes connected to the respectively corresponding output terminals.

8. The driver circuit according to claim 1, wherein each of the plurality of drivers comprises an analog switch.

9. The driver circuit according to claim 1, wherein each of the plurality of drivers comprises an amplifier.

10. The driver circuit according to claim 1, wherein each of the plurality of drivers comprises an inverter outputting a high-level voltage and a low-level voltage.

11. The driver circuit according to claim 1, wherein the driver circuit drives a matrix-type display panel.

12. The driver circuit according to claim 1, the driver circuit drives a print head.

13. A driver circuit, driving a plurality of load devices, the driver circuit comprising:

a plurality of output terminals, connected to the plurality of load devices;

a plurality of drivers, corresponding to the plurality of output terminals, generating driving signals applied to the respectively corresponding load devices;

a plurality of first diodes, corresponding to the plurality of output terminals, connected to the respectively corresponding output terminals; and a plurality of clamp circuits, corresponding to the plurality of drivers, comprising second diodes connected to input nodes or output nodes of the respectively corresponding drivers;

wherein, the driver circuit is integrated on a semiconductor substrate, and a forward voltage of the second diode is smaller than that of the first diode, wherein the plurality of first diodes and the plurality of second diodes are disposed within the driver circuit.

14. The driver circuit according to claim 13, wherein the second diode is a Schottky diode.

15. The driver circuit according to claim 13, further comprising:

a plurality of bypass circuits, corresponding to the plurality of drivers, comprising capacitors connected to the input nodes or output nodes of the respectively corresponding drivers.

16. A driver circuit, driving a plurality of load devices, the driver circuit comprising:

a plurality of output terminals, connected to the plurality of load devices;

a plurality of drivers, corresponding to the plurality of output terminals, generating driving signals applied the respectively corresponding load devices;

a plurality of clamp circuits, corresponding to the plurality of drivers, connected to input nodes or output nodes of the respectively corresponding drivers; and a plurality of bypass circuits, corresponding to the plurality of drivers, comprising capacitors connected to input nodes or output nodes of the respectively corresponding drivers;

wherein, the driver circuit is integrated on a semiconductor substrate, and each one of the drivers is respectively connected to each one of the corresponding load devices via each one of the corresponding clamp circuits.

* * * * *